US007377239B2

(12) United States Patent
Roth

(10) Patent No.: US 7,377,239 B2
(45) Date of Patent: May 27, 2008

(54) METHOD FOR OPERATING AN INTERNAL COMBUSTION ENGINE, COMPUTER PROGRAM PRODUCT, COMPUTER PROGRAM, AND CONTROL AND/OR REGULATING DEVICE FOR AN INTERNAL COMBUSTION ENGINE

(75) Inventor: Andreas Roth, Muehlacker-Lomersheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/716,071

(22) Filed: Mar. 8, 2007

(65) Prior Publication Data

US 2007/0227497 A1 Oct. 4, 2007

(30) Foreign Application Priority Data

Mar. 9, 2006 (DE) ..... 10 2006 010 903

(51) Int. Cl.
*F01L 1/26* (2006.01)
*F01L 1/46* (2006.01)

(52) U.S. Cl. ..... 123/90.1; 123/325; 123/479

(58) Field of Classification Search ..... 123/325, 123/479, 90.1
See application file for complete search history.

(56) References Cited

U.S. PATENT DOCUMENTS 4,779,589 A * 10/1988 Matsuura et al. ..... 123/90.15
6,435,147 B1 * 8/2002 Eichenseher et al. .... 123/90.11
6,840,213 B2 * 1/2005 Takahashi et al. ..... 123/325
6,990,937 B2 * 1/2006 Shindou et al. ..... 123/90.15

* cited by examiner

*Primary Examiner*—Erick Solis
(74) *Attorney, Agent, or Firm*—Kenyon & Kenyon LLP

(57) ABSTRACT

A method for operating an internal combustion engine, a computer program product, a computer program, and a control and/or regulating device for an internal combustion engine make detection of an erroneously permanently closed intake valve for a cylinder of the internal combustion engine having more than one intake valve possible. Air and fuel are supplied to the cylinder of the internal combustion engine via a plurality of intake valves. The air and fuel are supplied to the cylinder via a shared duct, which opens into separate ducts for each intake valve of the cylinder. The separate ducts have the same volume. After an interruption of the fuel supply to the cylinder, the fuel supply is resumed. Starting at a first point in time of the resumption of the fuel supply, the fuel quantity supplied to one of the separate ducts is ascertained assuming a permanently closed associated intake valve. A second point in time since the resumption of the fuel supply, at which the separate duct would be completely filled with fuel for the first time if the associated intake valve were permanently closed, is ascertained from the ascertained fuel quantity. A check is performed of whether the cylinder has relatively more combustion misses between the first point in time and the second point in time than after the second point in time. In this instance, it is concluded that an intake valve of the cylinder is erroneously closed.

12 Claims, 2 Drawing Sheets

METHOD FOR OPERATING AN INTERNAL COMBUSTION ENGINE, COMPUTER PROGRAM PRODUCT, COMPUTER PROGRAM, AND CONTROL AND/OR REGULATING DEVICE FOR AN INTERNAL COMBUSTION ENGINE

CROSS-REFERENCE TO RELATED APPLICATIONS

The present application claims priority to Application No. 10 2006 010 903.1, filed in the Federal Republic of Germany on Mar. 9, 2006, which is expressly incorporated herein in its entirety by reference thereto.

FIELD OF THE INVENTION

The present invention relates to a method for operating an internal combustion engine, to a computer program product, a computer program, and a control and/or regulating device for an internal combustion engine.

BACKGROUND INFORMATION

Supplying air and fuel to a cylinder of an internal combustion engine via a plurality of intake valves is conventional, the air and the fuel being supplied to the cylinder via a shared duct which opens into a separate duct for each intake valve of the cylinder. Furthermore, in certain arrangements of such an internal combustion engine, these separate ducts have the same volume. Furthermore, suppressing the fuel supply to the cylinder in such internal combustion engines and resuming the fuel supply to this cylinder after an interruption in the fuel supply is convention.

SUMMARY

Example embodiments of the method for operating an internal combustion engine, the computer program product, the computer program, and the control and/or regulating device for an internal combustion engine, as described below, may provide that the fuel quantity supplied at least partially to one of the separate ducts starting at a first point in time from the partial resumption of fuel supply is ascertained assuming a permanently closed associated intake valve, that a second point in time since the resumption of the fuel supply at which point in time the separate duct would be completely filled with fuel for the first time in the event of a permanently closed associated intake valve is ascertained from the ascertained fuel quantity, that a check is performed of whether the cylinder has comparatively more combustion misses between the first point in time and the second point in time than after the second point in time, and that in this instance an erroneously closed intake valve of the cylinder is inferred. This permits an erroneously closed intake valve of the cylinder to be detected.

The detection of the erroneously closed intake valve becomes simple, e.g., due to the fact that a defective intake valve is inferred when the cylinder has more combustion misses between the first point in time and the second point in time than in a time period of the same length after the second point in time.

The second point in time may be ascertained in a particularly simple manner by integrating a fuel mass flow injected since the first point in time to ascertain the fuel quantity injected at least partially into the separate duct.

The fuel quantity supplied at least partially into the separate duct may be ascertained accurately, e.g., if an evaporating fuel quantity is taken into account.

The fuel quantity injected for the cylinder since the resumption of fuel supply may be ascertained, as a function of at least one operating point of the internal combustion engine, at which the separate duct is completely filled with fuel, assuming a permanently closed associated intake valve. This permits the second point in time to be ascertained in a particularly simple and accurate manner as a function of the instantaneous operating point of the internal combustion engine.

The at least one operating point of the internal combustion engine may be selected as a function of an engine temperature and/or an intake manifold pressure. This permits the fuel quantity evaporating as a function of the engine temperature and/or the intake manifold pressure to be taken into account, e.g., in ascertaining the fuel quantity supplied to the separate duct and thus in ascertaining the second point in time, and thus the fuel quantity supplied to the separate duct and thus the second point in time to be ascertained even more accurately.

The reliability of detection of an erroneously closed intake valve of the cylinder may be increased if an erroneously closed intake valve is inferred only when a predefined number of combustion misses is reached or exceeded between the first point in time and the second point in time.

The reliability of detection of an erroneously closed intake valve of the cylinder may also be increased if an erroneously closed intake valve is inferred only when, for at least one predefined time period after the second point in time, the number of detected combustion misses in the cylinder is less than a predefined value, e.g., equal to zero.

The detection of an erroneously closed intake valve of the cylinder may be implemented in a simple and reliable manner by selecting the ratio between the predefined number and the time between the first point in time and the second point in time to be greater than the ratio between the predefined value and the predefined time period.

The method according to example embodiments of the present invention may be suitable, e.g., for internal combustion engines which may be switched between half-engine operation and full-engine operation, in which instance the first point in time may simply be selected as the point in time when the internal combustion engine is switched over from half-engine operation into full-engine operation. For example, at this point in time the fuel supply into the cylinders of the internal combustion engine not fired during the half engine operation is resumed.

Example embodiments of the present invention are described in further detail below with reference to the appended Figures.

DETAILED DESCRIPTION

Figure 1:
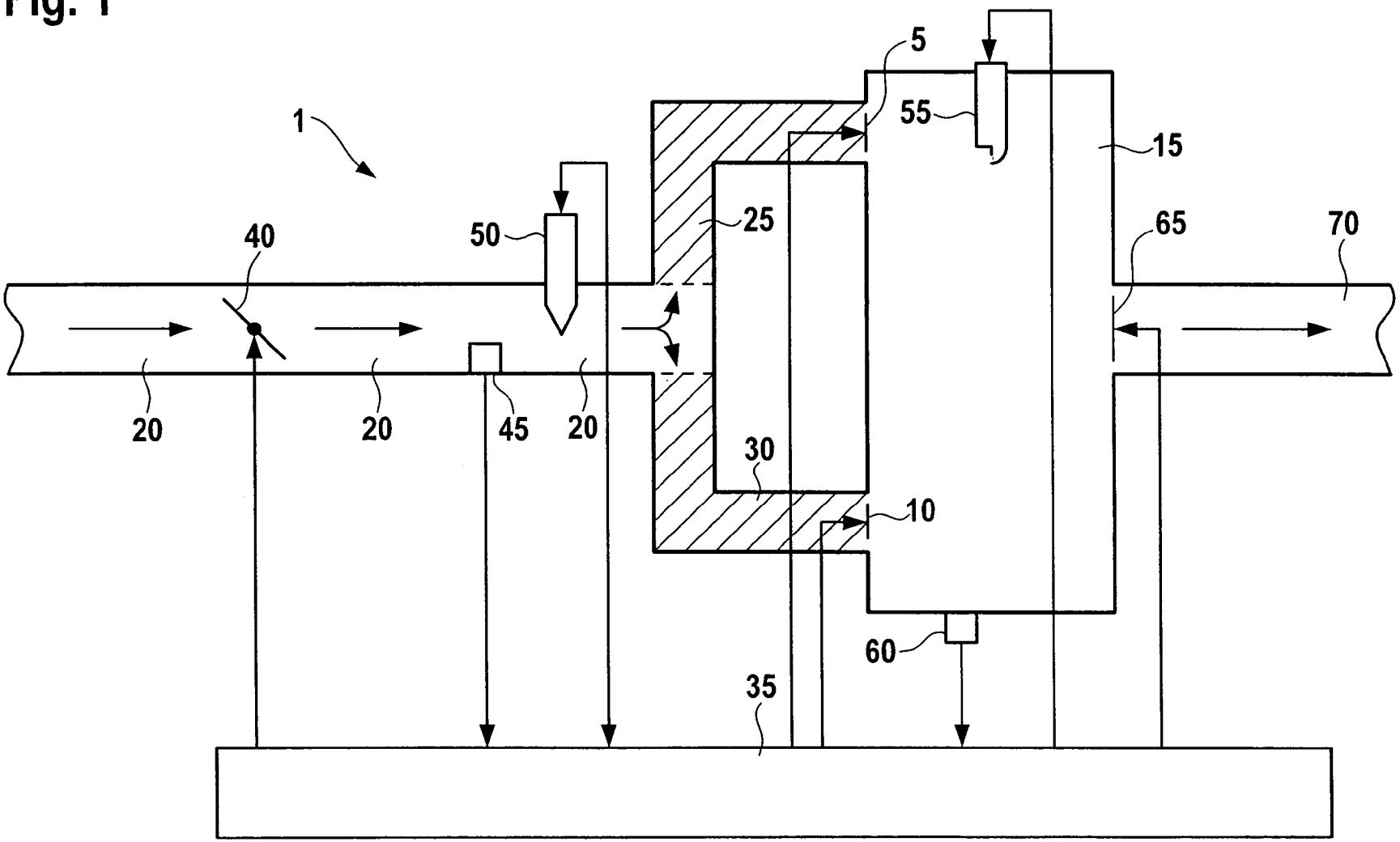
FIG. 1 is a block diagram of an internal combustion engine.

In FIG. 1, reference numeral 1 identifies an internal combustion engine, which propels a vehicle, for example.

Internal combustion engine 1 may be arranged as a gasoline engine having intake manifold injection, for example. In the following, it is be assumed, for example, that internal combustion engine 1 is arranged as a gasoline engine. Internal combustion engine 1 includes one or more cylinders, one of which is depicted as an example in FIG. 1 and identified with reference numeral 15. Air and fuel are supplied to cylinder 15 via a shared duct 20. The flow direction in shared duct 20 is indicated by arrows in FIG. 1. Shared duct 20 includes a throttle valve 40, whose degree of opening or position is set by a control and/or regulating unit 35, which is referred to hereinafter as an engine controller. The position of throttle valve 40 may be set by engine controller 35, for example, in a conventional manner, as a function of the position of an accelerator pedal. The portion of shared duct 20 downstream from throttle valve 40 is also referred to as an intake manifold. Fuel is injected into the intake manifold via an injector 50. Injector 50 is also triggered by engine controller 35, for example, to set a predefined air/fuel mixture ratio. Furthermore, injector 50 may also be triggered by engine controller 35 such that the fuel supply is interrupted, for example, in a half-engine operation, where only one-half of the cylinders of internal combustion engine 1 are fired, and the fuel supply is resumed again via injector 50 after switching over from half-engine operation into full-engine operation, as long as injector 50 is exclusively assigned to one or more cylinders that may be turned off in this manner. Injector 50 also has a position feedback which provides feedback of the degree of opening or the position of injector 50 to engine controller 35, e.g., in a conventional manner. Alternatively, the position or the degree of opening of injector 50 or the injection time is known from the trigger signal of engine controller 35. An intake manifold pressure sensor 45, which measures the intake manifold pressure in the intake manifold and transmits a corresponding measuring signal to engine controller 35, is arranged in the intake manifold. Alternatively, the intake manifold pressure may also be determined from models, based on the air mass flow and/or the throttle valve angle.

Downstream from injector 50, shared duct 20, and thus the intake manifold, splits into a first separate duct 25 and a second separate duct 30. Injector 50 may be arranged as a dual-jet injector, one jet for each duct 25, 30. First separate duct 25 opens into a combustion chamber of cylinder 15 via a first intake valve 5. Second separate duct 30 opens into the combustion chamber of cylinder 15 via a second intake valve 10. In the following, it is assumed that both separate ducts 25, 30 have a same volume arrangement, i.e., have the same geometric volume. This is, however, not absolutely necessary. First intake valve 5 is assigned to first separate duct 25, and second intake valve 10 is assigned to second separate duct 30. As FIG. 1 illustrates, for example, first intake valve 5 and second intake valve 10 may be triggered for opening or closing by engine controller 35, for example, via an electrohydraulic valve control. Alternatively, intake valves 5, 10 may each be caused to open or close with the aid of a separate intake camshaft. The air/fuel mixture reaching the combustion chamber of cylinder 15 via first intake valve 5 and second intake valve 10 is ignited by a spark plug 55. The ignition point in time of spark plug 55 is also set by engine controller 35 to set a desired combustion center of gravity or to build up a desired torque reserve of internal combustion engine 1 or to heat a catalytic converter in an exhaust tract 70 of internal combustion engine 1. Furthermore, a temperature sensor 60 is provided, which measures the temperature of internal combustion engine 1 and transmits a corresponding measuring signal to engine controller 35. Temperature sensor 60 may measure, for example, a coolant temperature or an engine oil temperature of internal combustion engine 1. Alternatively, temperature sensor 60 may also be arranged in shared duct 20, e.g., in the intake manifold or in first separate duct 25 or in second separate duct 30 and measure the temperature prevailing there. The exhaust gas formed during combustion of the air/fuel mixture in the combustion chamber of cylinder 15 is expelled into exhaust tract 70 via exhaust valves 65. Exhaust valve(s) 65 are also caused to open or close by engine controller 35 or by an exhaust camshaft. For triggering by engine controller 35, this may also take place via electrohydraulic valve control. When one or more intake valves or exhaust valves (in general, gas exchange valves) are deactivated, for example, in half-engine operation, the frictional connection of the particular intake or exhaust camshaft with the corresponding gas exchange valve(s) is interrupted hydraulically or electromechanically by control elements.

Air and fuel may be supplied to cylinder 15 first via shared duct 20 and then, on the one hand, via first separate duct 25 and first intake valve 5 and, on the other hand, via second separate duct 30 and second intake valve 10.

The situation will now be discussed in which first the fuel supply into shared duct 20 via injector 50 is interrupted, for example, in an operating state of internal combustion engine 1 in which one-half of the cylinders of internal combustion engine 1 is not fired and not supplied with fuel. At a first point in time, fuel supply to cylinder 15 via injector 50 is resumed, for example, when the engine is switched over from half-engine operation to full-engine operation at first point in time and all cylinders of internal combustion engine 1 are to be fired and supplied with fuel again. When, after such an activation of cylinder 15 at the first point in time, one of the two intake valves 5, 10 remains erroneously permanently closed, the other of the two intake valves 5, 10, however, may be opened and closed error-free, the following takes place.

Cylinder 15 has combustion misses because, although it receives, via the intake valve functioning error-free, the full air charge supplied via shared duct 20, one-half of the fuel quantity injected into shared duct 20 is first temporarily accumulated in the separate duct assigned to the erroneously permanently closed intake valve upstream from the erroneously permanently closed intake valve. As soon as the separate duct which is assigned to the erroneously permanently closed intake valve is fully filled with fuel, cylinder 15 receives the full fuel quantity injected by injector 50 via the intake valve functioning error-free, whereby the number of combustion misses in cylinder 15 is reduced again, in the best case to zero.

The method according to example embodiments of the present invention makes use of this effect. Separate ducts 25, represent those ducts illustrated in FIG. 1 which lead from shared duct 20 to the particular intake valve 5, 10 associated with them. They are illustrated shaded in FIG. 1. They do not overlap and extend from the respective intake valves 5, 10 to shared duct 20.

At least a portion of the fuel mass flow injected by injector 50 into shared duct 20, i.e., the fuel quantity injected by injector 50 into shared duct 20, reaches first separate duct 25. At least a portion of the fuel quantity injected by injector 50 into shared duct 20 reaches second separate duct 30. This is true even in the case where one of the two intake valves 5, 10 is erroneously permanently closed or is assumed to be erroneously permanently closed.

It is provided that, starting at the first point in time of the resumption of the fuel supply, the fuel quantity supplied to one of separate ducts 25, 30 is ascertained assuming a permanently closed associated intake valve 5, 10. A second point in time since the resumption of the fuel supply, at which the separate duct would be completely filled with fuel for the first time if associated intake valve 5, 10 were permanently closed, is ascertained from the ascertained fuel quantity. A check is furthermore performed of whether cylinder 15 has relatively more combustion misses between the first point in time and the second point in time than after the second point in time. In this instance, it is concluded that one of intake valves 5, 10 of cylinder 15 is erroneously closed. Erroneously closed refers to undesirably permanently closed and no longer openable.

A check is therefore performed, for example, for detecting the erroneously closed intake valve, whether the ratio of the number of combustion misses between the first point in time and the second point in time to the time period defined by the first point in time and the second point in time is greater than the ratio of the number of combustion misses in a predefined time interval after the second point in time to the predefined time interval. The length of the predefined time interval after the second point in time should be selected to be sufficient for obtaining a reliable value for the above-mentioned ratio after the second point in time. For example, the predefined time interval may be suitably calibrated accordingly on a test bench.

The erroneously closed intake valve may be detected in a particularly simple manner by comparing the number of combustion misses in the time period between the first point in time and the second point in time with the number of combustion misses in a time period of the same length after the second point in time. If the number of combustion misses between the first point in time and the second point in time is greater than the number of combustion misses in the time period of the same length after the second point in time, an erroneously closed intake valve is inferred.

The second point in time may be ascertained, for example, as follows.

On the one hand, the fuel mass flow injected by injector 50 into shared duct 20 or, in the case of a multijet injector, into the particular duct 25, 30, is ascertained in engine controller 35, e.g., in a conventional manner, from the injection time of injector 50. Furthermore, the fuel mass flow injected by injector 50 is ascertained not only as a function of the injection time of injector 50, but, on the other hand, e.g., in a conventional manner, also as a function of the fuel pressure which is also known in engine controller 35. Engine controller 35 integrates the injected fuel mass flow from the first point in time starting at value zero. The geometry of first separate duct 25 and the geometry of second separate duct 30 and therefore the volume of first separate duct 25 and second separate duct 30 are known and stored in engine controller 35. As described previously, the two separate ducts 25, 30, may, but not necessarily, have the same volume.

Due to the known position of the installation site of injector 50 and the known geometric dimensions of shared duct 20, the volume of shared duct 20, which is filled with fuel when fuel is injected by injector 50, is also known in engine controller 35. It may thus be ascertained, either by calculation or by calibration on a test bench and/or in driving tests, at which value of the fuel quantity ascertained by integration of the fuel mass flow injected by injector 50 one of the two separate ducts 25, 30 is completely filled with fuel, assuming that the associated intake valve is erroneously permanently closed and the intake valve associated with the other separate duct operates error-free. If the volumes of the two ducts 25, 30 are different, different second points in time result for the two ducts. In the following, it is assumed for simplicity that the two ducts 25, 30 have the same volume. The point in time at which this calculated or calibrated fuel quantity is first attained represents the previously described second point in time. The determination of this second point in time becomes even more accurate if the evaporating fuel quantity is taken into account when ascertaining the fuel quantity supplied by injector 50 since the first point in time. The evaporating fuel quantity is a function of the operating point of internal combustion engine 1. The evaporating fuel quantity is a function of the engine temperature and the intake manifold pressure, e.g., Thus, for example, an associated evaporating fuel quantity may be calibrated on a test bench for different operating points of internal combustion engine 1 regarding engine temperature and/or intake manifold pressure and stored in engine controller 35 or in a memory associated with engine controller 35 in the form of a characteristics map. The above-described fuel quantity injected by injector 50 and ascertained by integration may thus be corrected as a function of the instantaneous operating point of internal combustion engine 1 regarding engine temperature and/or intake manifold pressure with the aid of the calibrated characteristics map regarding the resulting evaporating fuel quantity by subtracting the evaporating fuel quantity from the injected fuel quantity ascertained by integration. The second point in time is determined more accurately in this manner, e.g., by taking into account the instantaneous operating point of the internal combustion engine regarding engine temperature and/or intake manifold pressure.

To increase the reliability of the above-described diagnostic method, it may be optionally provided that an erroneously closed intake valve of the cylinder is inferred only when a predefined number of combustion misses is reached or exceeded between the first point in time and the second point in time. The predefined number may be suitably calibrated, for example, on a test bench and/or in driving tests such that, on the one hand, it is not too small so that individual combustion misses triggered independently of an erroneously closed intake valve are not immediately attributed to an erroneously closed intake valve. On the other hand, the predefined number should not be calibrated to be too large, so that an erroneously closed intake valve may also be reliably detected in the time window defined by the first point in time and the second point in time using the combustion misses possibly occurring in this time window. The predefined number may be calibrated as a function of the time window resulting between the first point in time and the second point in time, to be the larger the larger this time window is.

Furthermore, the reliability of the above-described diagnosis of intake valves 5, 10 may be enhanced if a defective intake valve is inferred only when, for at least one predefined time period after the second point in time, the number of detected combustion misses in cylinder 15 is less than a predefined value, e.g., equal to zero. The predefined time period may be suitably calibrated, for example, on a test bench and/or in driving tests such that, on the one hand, it is selected to be sufficiently large to allow a number of combustion misses to be detected for a reliable diagnosis, but, on the other hand, is as small as possible to keep the duration of the diagnosis as short as possible. The predefined value may be suitably calibrated, for example, also on a test bench and/or in driving tests such that, on the one hand, it is selected to be as small as possible to obtain a significant difference in the number of combustion misses between the first point in time and the second point in time on the one hand and during the predefined time period after the second point in time on the other hand. For this purpose, in an ideal case, no combustion misses should occur during the predefined time period after the second point in time. However, in order not to affect the result of the diagnosis by individual combustion misses occurring after the second point in time independently of an erroneously closed intake valve, one may make sure in this calibration of the predefined value that the predefined value is not set too small.

In order to reliably diagnose an erroneously closed intake valve 5, 10 it may be, however, necessary that the ratio between the predefined number of combustion misses between the first point in time and the second point in time and the time period between the first point in time and the second point in time is selected to be greater than the ratio between the predefined value for the number of detected combustion misses during the predefined time period since the second point in time and this predefined time period.

Figure 2:
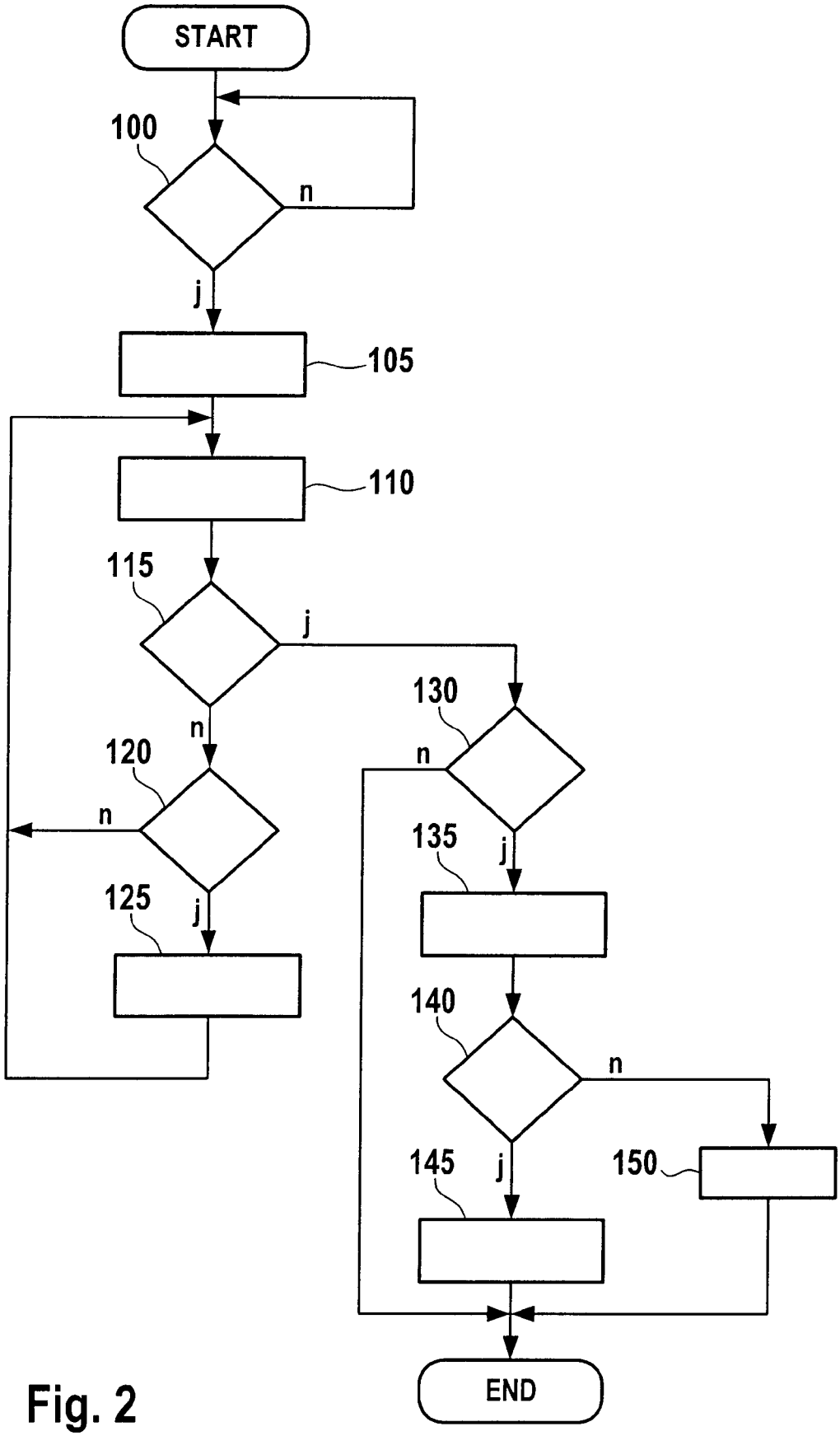
FIG. 2 is a flow chart of an exemplary sequence of a method according to an example embodiment of the present invention.

FIG. 2 is a flow chart illustrating a sequence of a method according to an example embodiment of the present invention. After the start of the program, engine controller 35 checks whether there is a request for switching over from half-engine operation to full-engine operation. If this is the case, the program branches off to a program point 105. Otherwise, the program branches back to program point 100.

At program point 105, engine controller 35 initiates the fuel injection by injector 50 to supply fuel to cylinder 15, which was not previously fired or supplied with fuel. In addition, a numerical variable n is set to zero. Furthermore, an integration starting value is initialized using the value zero for a subsequent ascertainment of the fuel quantity injected by injector 50. The point in time of injection start at program point 105 corresponds to the previously described first point in time. The program then branches off to program point 110.

At program point 110 engine controller 35 performs an integration step by adding an instantaneous value resulting from the instantaneous injection time of injector 50 and the instantaneous fuel pressure in the fuel supply of injector 50 to the previously ascertained or initialized injected fuel quantity. Furthermore, engine controller 35 subtracts a value for the currently evaporating fuel quantity from the fuel quantity value so ascertained, as a function of the instantaneous engine temperature and/or the instantaneous intake manifold pressure according to the above-described characteristics map. In this manner, at the end of program step 110, the fuel quantity injected by injector 50 since the first point in time, less the evaporated fuel quantity, is available as a calculated value in engine controller 35.

The program then branches off to a program point 115.

At program point 115, engine controller 35 checks, as described previously, whether the calculated or calibrated value of the injected fuel quantity has been reached at which the associated separate duct is completely filled with fuel assuming an erroneously closed intake valve. If this is the case, the program branches off to a program point 130. Otherwise, the program branches off to a program point 120.

If the answer to the query at program point 115 is positive, the program branches off to program point 130. This means that the second point in time has been reached.

At program point 120, engine controller 35 checks, e.g., in a conventional manner, whether there is a combustion miss in cylinder 15. If this is the case, the program branches off to a program point 125. Otherwise, the program branches back to a program point 110 and the next integration step for ascertaining the injected fuel quantity is initiated.

At program point 125, numerical variable n is incremented by one. Subsequently the program branches off to program point 110 and the next integration step is initiated for ascertaining the fuel quantity injected by injector 50.

At program point 130, engine controller 35 checks whether numerical variable n has reached or exceeded the predefined number of combustion misses. If this is the case, the program branches off to point 135. Otherwise, the program is terminated and no erroneously closed intake valve is detected.

At program point 135, engine controller 35 ascertains the number of combustion misses occurring in cylinder 15 during the predefined time period after the second point in time. The predefined time period may in this instance be selected to be exactly as long as the time window between the first point in time and the second point in time. The program then branches off to a program point 140.

At program point 140, engine controller 35 checks whether the number of combustion misses in cylinder 15 ascertained during the predefined time period after the second point in time is smaller than the predefined value. If this is the case, the program branches off to a program point 145. Otherwise, the program branches off to a program point 150 and no erroneously closed intake valve is recognized.

In the instance in which the predefined time period after the second point in time is selected to be equal to the time period between the first point in time and the second point in time, the predefined value may be selected, in a simplest manner, to be equal to the number of combustion misses that were ascertained previously in the time window between the first point in time and the second point in time. To increase the reliability of the diagnosis, the predefined value may be selected to be equal to the number of combustion misses ascertained between the first point in time and the second point in time less a predefined tolerance value to increase the reliability of the diagnosis. The predefined tolerance value may be suitably calibrated, for example, on a test bench and/or in driving tests such that a fluctuation of the number of combustion misses not caused by an erroneously closed intake valve does not result in a possibly erroneous diagnosis of an erroneously closed intake valve when the time window between the first point in time and the second point in time is compared to the predefined time period after the second point in time. In general, or, e.g., in the case where the predefined time period after the second point in time is selected to be unequal to the time period between the first point in time and the second point in time, a check is performed by engine controller 35 at program point 140 of whether the ratio of the number of combustion misses ascertained during the predefined time period after the second point in time to this predefined time period, possibly taking into account a tolerance value, is less than the ratio of number n of combustion misses ascertained between the first point in time and the second point in time to the time period between the first point in time and the second point in time. If this is the case, the program branches off to a program point 145. Otherwise, the program branches off to a program point 150 and no erroneously closed intake valve is detected.

At program point 145, engine controller 35 detects an erroneously closed intake valve. The diagnosis does not allow one to tell whether first intake valve 5 or second intake valve 10 is erroneously permanently closed, i.e., stuck. An erroneously stuck intake valve may be detected only if at least one of the two intake valves 5, 10 is not erroneously permanently closed, but opens and closes error-free.

The method may be implemented in a similar manner in the case of more than two intake valves and associated separate ducts per cylinder, in which case at least one of the intake valves should open and close error-free for error detection. The error detection does not specify whether one or more of the intake valve(s) of cylinder 15 is/are stuck and erroneously permanently closed. However, the number of erroneously permanently closed intake valves may be inferred as a function of the difference between the number of combustion misses during the time window between the first point in time and the second point in time on the one hand and the number of combustion misses during the predefined time period after the second point in time on the other hand, e.g., when the predefined time period after the second point in time is exactly as long as the time window between the first point in time and the second point in time. The greater the difference in the number of combustion misses in the two above-mentioned time periods, the greater the number of erroneously permanently closed intake valves. An association of the difference between the number of combustion misses in the two above-mentioned time periods and the number of erroneously permanently closed intake valves may be calibrated, for example, on a test bench and/or in driving tests. The rest of the method may be performed as described previously. For example, the second point in time may be ascertained as described previously, i.e., as the point in time at which one of the separate ducts is completely filled with fuel assuming that the associated intake valve is erroneously permanently closed. Also in the case of more than two intake valves, it may, but not necessary, be that the particular associated separate ducts have the same volume.

The program is terminated after program point 145.

In the case where the test result at program point 140 is negative, the program branches off to a program point 150.

At program point 150, engine controller 35 detects a combustion error which is not attributable to one or more erroneously permanently closed intake valves and also results in an excessively high number of combustion misses. This error is displayed to the driver of the vehicle. Additionally or alternatively, a limp-home operation of internal combustion engine 1 is initiated, for example, by reducing the propulsion power output by internal combustion engine 1. This may be accomplished by increased throttling of the air supply or repeated suppression of the fuel injection for cylinder 15. Ultimately, internal combustion engine 1 is shut off. The program is subsequently terminated.

The program may be executed on a microprocessor of engine controller 35 as a computer program and may be stored, for example, in the form of a computer program product on a machine-readable medium, for example, in the form of a memory medium, which is permanently installed in engine controller 35 or supplied to engine controller 35 via a disk drive.

In the event of a detection of one or more erroneously permanently closed intake valves, an appropriate warning may be output to the driver of the vehicle or an appropriate record may be written to an error memory readable in a repair shop. Additionally or alternatively, a limp-home operation of internal combustion engine 1 at reduced power may be initiated. Ultimately, internal combustion engine 1 may also be entirely shut off if one or more erroneously closing intake valve(s) is/are detected.

Since cylinder 15 having the detected combustion misses is known, the detected erroneously permanently closing intake valve may be unambiguously assigned to the corresponding cylinder, for example, when the error memory is read in the repair shop.

If the second points in time are different in ducts 25, 30, the method is performed, for example, first for the shorter of the two second points in time. However, if no error is recognized, the method is subsequently performed for the larger of the two second points in time.

What is claimed is:

1. A method for operating an internal combustion engine, comprising:

supplying air and fuel to a cylinder of the internal combustion engine via a plurality of intake valves, the air and the fuel supplied to the cylinder via a shared duct that opens into separate ducts for respective intake valves of the cylinder, the separate ducts having a same volume;

resuming the fuel supply to the cylinder after an interruption of the fuel supply;

wherein, starting at a first point in time of the resumption of the fuel supply, a fuel quantity at least partially supplied to at least one of the separate ducts is ascertained assuming a permanently closed, associated intake valve, a second point in time since the resumption of the fuel supply, at which point in time the separate duct would be completely filled with fuel for a first time in the event of a permanently closed, associated intake valve, is ascertained from the ascertained fuel quantity, a check is performed of whether the cylinder has relatively more combustion misses between the first point in time and the second point in time than after the second point in time, and in this instance, an erroneously closed intake valve of the cylinder is inferred.

2. The method according to claim 1, wherein an erroneously closed intake valve is inferred when the cylinder has more combustion misses between the first point in time and the second point in time than in a time period of a same length after the second point in time.

3. The method according to claim 1, wherein a mass flow rate of fuel injected since the first point in time is integrated to ascertain the quantity of fuel injected at least partially into the separate duct.

4. The method according to claim 1, wherein the fuel quantity supplied at least partially to the separate duct is ascertained taking into account a quantity of evaporating fuel.

5. The method according to claim 1, wherein the fuel quantity injected for the cylinder since the resumption of fuel supply, at which fuel quantity the separate duct is completely filled with fuel under an assumption of a permanently closed, associated intake valve, is determined as a function of at least one operating point of the internal combustion engine.

6. The method according to claim 5, wherein the at least one operating point of the internal combustion engine is selected as a function of at least one of (a) an engine temperature and (b) an intake manifold pressure.

7. The method according to claim 1, wherein an erroneously closed intake valve is inferred only when a predefined number of combustion misses is at least one of (a) reached and (b) exceeded between the first point in time and the second point in time.

8. The method according to claim 1, wherein an erroneously closed intake valve is inferred only when, for at least one predefined time period after the second point in time, the number of detected combustion misses in the cylinder is at least one of (a) less than a predefined value and (b) equal to zero.

9. The method according to claim 7, wherein an erroneously closed intake valve is inferred only when, for at least one predefined time period after the second point in time, the number of detected combustion misses in the cylinder is at least one of (a) less than a predefined value and (b) equal to zero, and wherein a ratio of the predefined number to the time period between the first point in time and the second point in time is greater than a ratio of the predefined value to the predefined time period.

10. The method according to claim 1, wherein the first point in time is selected as the point in time of a switchover from a half-engine operation to a full-engine operation of the internal combustion engine.

11. A computer-readable medium having stored thereon instructions adapted to be executed by a processor, the instructions which, when executed, cause the processor to perform a method for operating an internal combustion engine, the method including:

supplying air and fuel to a cylinder of the internal combustion engine via a plurality of intake valves, the air and the fuel supplied to the cylinder via a shared duct that opens into separate ducts for respective intake valves of the cylinder, the separate ducts having a same volume;

resuming the fuel supply to the cylinder after an interruption of the fuel supply;

wherein, starting at a first point in time of the resumption of the fuel supply, a fuel quantity at least partially supplied to at least one of the separate ducts is ascertained assuming a permanently closed, associated intake valve, a second point in time since the resumption of the fuel supply, at which point in time the separate duct would be completely filled with fuel for a first time in the event of a permanently closed, associated intake valve, is ascertained from the ascertained fuel quantity, a check is performed of whether the cylinder has relatively more combustion misses between the first point in time and the second point in time than after the second point in time, and in this instance, an erroneously closed intake valve of the cylinder is inferred.

12. A control/regulating unit for an internal combustion engine programmed to perform a method for operating an internal combustion engine, the method including:

supplying air and fuel to a cylinder of the internal combustion engine via a plurality of intake valves, the air and the fuel supplied to the cylinder via a shared duct that opens into separate ducts for respective intake valves of the cylinder, the separate ducts having a same volume;

resuming the fuel supply to the cylinder after an interruption of the fuel supply;

wherein, starting at a first point in time of the resumption of the fuel supply, a fuel quantity at least partially supplied to at least one of the separate ducts is ascertained assuming a permanently closed, associated intake valve, a second point in time since the resumption of the fuel supply, at which point in time the separate duct would be completely filled with fuel for a first time in the event of a permanently closed, associated intake valve, is ascertained from the ascertained fuel quantity, a check is performed of whether the cylinder has relatively more combustion misses between the first point in time and the second point in time than after the second point in time, and in this instance, an erroneously closed intake valve of the cylinder is inferred.

* * * * *